US010535955B2

(12) United States Patent
Christen

(10) Patent No.: US 10,535,955 B2
(45) Date of Patent: Jan. 14, 2020

(54) PLUG ASSEMBLY, IN PARTICULAR FOR A COOLING CONTAINER

(71) Applicant: AMAD Mennekes Holding GmbH & Co. KG, Kirchhundem (DE)

(72) Inventor: Oliver Christen, Kirchhundem (DE)

(73) Assignee: AMAD MENNEKES HOLDING GMBH & CO. KG, Kirchhundem (DE)

( * ) Notice: Subject to any disclaimer, the term of this patent is extended or adjusted under 35 U.S.C. 154(b) by 0 days.

(21) Appl. No.: 16/093,484

(22) PCT Filed: Mar. 21, 2017

(86) PCT No.: PCT/EP2017/056661
§ 371 (c)(1),
(2) Date: Oct. 12, 2018

(87) PCT Pub. No.: WO2017/178198
PCT Pub. Date: Oct. 19, 2017

(65) Prior Publication Data

US 2019/0148886 A1 May 16, 2019

(30) Foreign Application Priority Data

Apr. 13, 2016 (DE) ..... 10 2016 106 829

(51) Int. Cl.
*H01R 13/645* (2006.01)
*H01R 29/00* (2006.01)
(Continued)

(52) U.S. Cl.
CPC ..... *H01R 13/6456* (2013.01); *H01R 24/70* (2013.01); *H01R 29/00* (2013.01); *H01R 2107/00* (2013.01)

(58) Field of Classification Search
CPC ..... H01R 13/6456; H01R 24/70; H01R 29/00
(Continued)

(56) References Cited

U.S. PATENT DOCUMENTS 3,079,475 A * 2/1963 Rumble ..... H01R 13/652 200/51 R
3,885,849 A * 5/1975 Bailey ..... H01R 13/506 439/320

(Continued)

FOREIGN PATENT DOCUMENTS

CN 105 140 684 12/2015
DE 89 07 886 8/1989

(Continued)

OTHER PUBLICATIONS

International Search Report issued by the European Patent Office in International Application PCT/EP2017/056661 dated May 19, 2017.

*Primary Examiner* — Oscar C Jimenez
(74) *Attorney, Agent, or Firm* — Henry M. Feierisen LLC

(57) ABSTRACT

A multi-pole plug assembly, in which the positions of a first contact element and a second contact element can be exchanged by means of a turning device is disclosed. The first and second contact elements can be different in terms of their plugging compatibility, for example, in that they are configured as contact pins of different diameters. In addition or alternatively, the first contact element can be connected to an outer conductor, and the second contact element can be connected to a protective conductor or a neutral conductor. The plug assembly can be embodied as a four-pole plug and configured in such a way that the first and second contact pins can adopt the positions $3^h$ and $6^h$ (or vice versa) in relation to a distinctive nose. Within the scope of DIN Standard EN 60309-2, two electrically similar configurations can be realized in this way.

4 Claims, 3 Drawing Sheets

(51) Int. Cl.
*H01R 24/70* (2011.01)
*H01R 107/00* (2006.01)

(58) Field of Classification Search
USPC ..... 439/171–172, 956
See application file for complete search history.

(56) References Cited

U.S. PATENT DOCUMENTS

| | | | | |
|---|---|---|---|---|
| 5,934,096 | A * | 8/1999 | Munson | H01R 29/00 307/147 |
| 6,139,345 | A * | 10/2000 | Muzslay | H01R 13/6608 439/189 |
| 10,122,123 | B1 * | 11/2018 | Tsfasman | H01R 13/6485 |
| 2009/0130892 | A1 | 5/2009 | Pech | |
| 2012/0021615 | A1 | 1/2012 | Wen | |
| 2012/0100733 | A1 * | 4/2012 | Lee | H01R 13/641 439/172 |
| 2012/0276785 | A1 * | 11/2012 | Bucheru | H01R 29/00 439/669 |
| 2014/0120750 | A1 * | 5/2014 | Johnson | H01R 27/00 439/131 |
| 2016/0233622 | A1 * | 8/2016 | Feldner | B60L 58/21 |
| 2017/0001529 | A1 * | 1/2017 | Fuchs | B60L 53/16 |
| 2017/0256899 | A1 * | 9/2017 | Mitchell | H01R 31/06 |

FOREIGN PATENT DOCUMENTS

| | | |
|---|---|---|
| DE | 102004033636 | 3/2005 |
| EP | 0 841 726 | 5/1998 |

* cited by examiner

| | F<br>Hz | U<br>V |
|---|---|---|
| 1 p + N + ⏚ | 50 + 60 | 100 – 130 |
| | 60 | 277 |
| 2 p + ⏚ | 50 + 60 | 100 – 130 |
| | | 200 – 250 |
| | | 380 – 415 |
| | | 480 – 500 |
| | | |
| | 100 – 300 | >50 |
| | >300 – 500 | >50 |
| | | >50 – 250 |
| | | >250 |
| 2 p + N + ⏚ | 50 + 60 | 125/250 |
| 2 p + N + ⏚ | 50 + 60 | |
| 3 p + ⏚ | 50 + 60 | 100 – 130 |
| | | 200 – 250 |
| | | 380 – 415 |
| | 60 | 440 – 460 |
| | 50 + 60 | 480 – 500 |
| | | 600 – 690 |
| | 50<br>60 | 380<br>440 |
| | 50 + 60 | 1000 |
| | 100 + 300 | >50 |
| | >300 – 500 | >50 |

Fig. 1

| 16/20 A<br>32/30 A | 63/60 A<br>125/100 A |
|---|---|
| 4 | 4 |
| 5 | 5 |
| 4 | 4 |
| 6 | 6 |
| 9 | 9 |
| 7 | 7 |
| 12 | 12 |
| 10 | 10 |
| 2 | 2 |
| 3 | 3 |
| 8 | 8 |
| 12 | 12 |
| 12 | 12 |
| 4 | 4 |
| 9 | 9 |
| 6 | 6 |
| 11 | 11 |
| 7 | 7 |
| 5 | 5 |
| 3 | 3 |
| - | 8 |
| 10 | 10 |
| 2 | 2 |
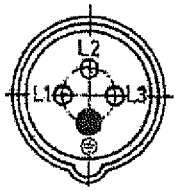
6h
"A"
"B"
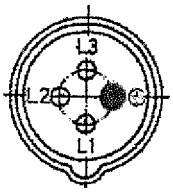
3h
Fig. 1 (Continuation)

PLUG ASSEMBLY, IN PARTICULAR FOR A COOLING CONTAINER

CROSS-REFERENCES TO RELATED APPLICATIONS

This application is the U.S. National Stage of International Application No. PCT/EP2017/056661, filed Mar. 21, 2017, which designated the United States and has been published as International Publication No. WO 2017/178198 and which claims the priority of German Patent Application, Serial No. 10 2016 106 829.2, filed Apr. 13, 2016, pursuant to 35 U.S.C. 119(a)-(d).

BACKGROUND OF THE INVENTION

The invention relates to a multi-pole plug assembly, in particular in the form of a plug, with several contact elements, two of which are arranged on a turning device.

For reasons of compatibility and operational safety, the structure of multi-pole electrical power plug assemblies is specified in standards such as DIN EN 60309-1 and DIN EN 60309-2. The interaction of a distinctive nose with a distinctive groove ensures hereby that a plug and a socket/coupling can be joined together only in a predefined relative rotational position with respect to the plugging axis. Furthermore, the standard specifies the position of the contact elements (contact pins or contact sleeves) in relation to the distinctive groove/nose for various electrical operating parameter ranges.

EP 841 726 A2 discloses a multi-pole plug assembly, in which two contact pins connected to an outer conductor are arranged on a rotatable rotor. This enables a user to exchange the positions of the two contact pins with otherwise identical plug image of all the contact pins of the plug assembly. With this device, known as a "phase reverser", the relative sequence of the electrical phases on the contact pins of the plug assembly can thus be changed in order, for example, to change the rotation direction of a connected three-phase machine.

Against this background, it was an object of the present invention to provide means for reliable, comfortable and flexible use of plug assemblies with standardized arrangements of the contact elements.

SUMMARY OF THE INVENTION

This object is achieved by a plug assembly according to claim 1 and claim 2. Preferred configurations are set forth in the subclaims.

The invention therefore relates to multi-pole plug assemblies, involving typically a plug assembly as a "plug" with contact pins or as a "socket" or "coupling" with contact sleeves. The assembly includes the following components:

a) At least two contact elements, i.e. electrically conductive structures, which come into contact with complementary contact elements of a complementary plug assembly in the mated state and thus enable transmission of current.

b) A turning device on which a first contact element and a second contact element of the afore-mentioned at least two contact elements are arranged, so that their positions can be exchanged by the user, if necessary.

According to a first aspect of the invention, such a multi-pole plug assembly is characterized in that the first contact element and the second contact element are different in terms of their plugging compatibility. That is, the first and second contact elements cannot both be mated with the same complementary contact element. For example, the first and second contact elements may have different (inner or outer) diameters. In particular, they can be cylindrical pins of different diameters (and/or different cross-sectional shape).

According to a second aspect, the multi-pole plug assembly with the afore-mentioned features a) and b) is characterized in that the first contact element is connected to an outer conductor and the second contact element to a protective conductor or to a neutral conductor. By definition, an "outer conductor" (also called "phase") should guide hereby in the operating state one of the phases of an electrical three-phase current. A "neutral conductor" is connected to the common node of the outer conductor, and the "protective conductor" (or ground conductor) is connected to earth or ground.

The features of the plug assemblies according to the first and second aspects may in particular be combined with each other. In other words, the first contact element connected to an outer conductor and the second contact element connected to a protective conductor can be different in terms of their plugging compatibility.

In known plug assemblies with a turning device, two identically shaped contact pins, which are connected to different outer conductors (phases), are exchanged with one another. In contrast thereto, in the plug assemblies according to the invention, a positional interchange of two contact elements is made possible, which are assigned to fundamentally different electrical functions. Thus, the plug assembly can be used together with complementary plug assemblies depending on positioning of the turning device, which are typically assigned in the context of a standard or norm to different categories (operating parameters).

The concrete technical design of the turning device can be implemented in various ways. In particular, the first and the second contact elements can be arranged on a common (insulating) rotor, which is rotatably supported on the remaining plug assembly insert, in which the remaining contact elements are mounted. Advantageously, the positions of the rotor in which the contact elements have just swapped their (standard) positions are stabilized and/or locked. This can be realized, for example, by a locking device. Rotation of the turning device and, optionally, release of a locking device is typically possible for the user without much difficulty, for example with a conventional screwdriver. The turning device is preferably accessible only when the plug assembly is not mated with another plug assembly so as to preclude operation in the current-carrying state. An exemplary concrete realization of a turning device can be taken from EP 841 726 A2, the contents of which are fully incorporated into the present application.

As already explained, the contact elements can be configured, for example, as contact sleeves or as contact pins (theoretically, a plug assembly may include a combination of contact pins and contact sleeves). Preferably, all contact elements are configured as contact pins, so that by definition the plug assembly involves a plug.

Furthermore, the plug assembly preferably has a distinctive feature, which permits a mating of the plug assembly with a complementary plug assembly only in a predefined relative rotational position (with respect to the plugging axis, in which direction the plug assemblies are plugged together). The distinctive feature can be configured in particular as a distinctive nose and/or distinctive groove. The uniqueness of mating relates hereby to the plug assemblies in their entirety, i.e. in particular with respect to their casing. Interchangeability of the positions of two contact elements relative to a plug assembly casing, which is the subject matter of the present invention, is independent thereof.

The plug assembly can be configured in terms of the geometric positions and/or shapes of its contact elements, in particular according to the standard DIN EN 60309-2. Optionally, other features of the plug assembly may also meet this standard.

The position of contact elements is referred to within the scope of the standard DIN EN 60309-2 via fictitious clock positions (in relation to the plan view upon a socket and with a predefined location of a distinctive feature such as e.g. a distinctive groove/nose). In this regard, the first contact element and the second contact element can be arranged in particular at positions $3^h$ (clock) or $6^h$ or vice versa (with location of the distinctive feature on $6^h$).

In addition or as an alternative, the plug assembly may also be designed such that the configuration resulting by exchanging the first and second contact elements allows safe operation of the plug assembly (or of the consumer connected thereto) in conjunction with plug assemblies according to the standard DIN EN 60309. In particular, regardless of the position of the turning device, no mating should be possible with a plug assembly according to DIN EN 60309, which causes overvoltage, for which the plug assembly and/or the consumer are not designed.

The plug assembly may in particular be four-pole, with the poles or contact elements being arranged at the corners of a square. Preferably, three contact elements are hereby occupied with the outer conductors (phases) of a three-phase alternating current and a fourth contact element with ground (protective conductor).

It is particularly preferred, when the plug assembly is a four-pole plug with an arrangement and shape of the contact pins according to the standard DIN EN 60309-2, wherein the contact pins of the $3^h$ and $6^h$ position (in relation to a corresponding socket!) are arranged on the turning device, so that their position can be exchanged, and wherein these interchangeable contact pins are connected to an outer conductor or to the protective conductor. According to standard DIN EN 60309-2, the plug assembly can then adopt the following configurations depending on the position of the turning device:

Protective conductor in $3^h$ position: operation at 380 V, 50 Hz or 440 Volt, 60 Hz.

Protective conductor in $6^h$ position: Operation at 380-415 V, 50 or 60 Hz.

The operating parameters of both configurations are electrically sufficiently similar so that a correspondingly designed consumer connected to the plug can be safely operated in both configurations.

Fixedly connected to the plug assembly according to the invention may be in particular a device (consumer), in particular a cooling unit. A "fixed" connection means hereby that this connection cannot be changed or released in a simple manner and/or without tool by a user. In particular, the separation of the plug assembly from the device may require the intervention of an expert and/or loosening of screws or clamp connections and/or may not be possible in a non-destructive manner. In this way, it is ensured that the variable plug assembly according to the invention is used only with a device designed for this purpose.

The device may in particular involve a cooling unit. Preferably, such a cooling unit is provided with a four-pole connector of the type mentioned above, in which the protective conductor contact pin can be placed selectively in $3^h$ position or in $6^h$ position. A safe operation of the cooling unit is then possible in both positions of the turning device.

According to a further aspect, the invention relates as separate element to a cooling unit, in particular in combination with a mobile cooling container, which is characterized in that it is equipped with a plug according to one of the afore-described embodiments.

BRIEF DESCRIPTION OF THE DRAWING

In the following, the invention is described in greater detail with the aid of the figures with reference to an exemplary embodiment. It is shown in:

FIG. 1 a section of a table of associations between protective conductor positions and electrical operating parameters according to standard DIN EN 60309-2;

DETAILED DESCRIPTION OF PREFERRED EMBODIMENTS

Figure 2:
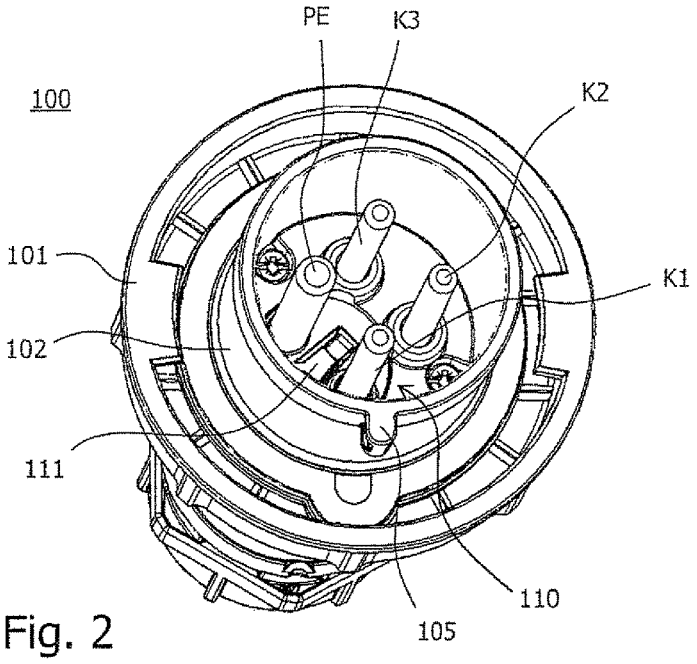
FIG. 2 a perspective view of a plug according to the invention with the protective conductor-contact element in $3^h$ position.

FIG. 1 reflects a simplified tabular overview of a part of the regulation content of standard DIN EN 60309-2. The table contains the associations specified in the standard between the "clock" positions of the protective conductor contact sleeve and the associated operating parameters of sockets, with the uniqueness groove by definition being at the $6^h$ position at all times. The clock positions of the complementary plugs, which are of primary interest here, are mirror images thereof. Not shown in the table are the definitions of color codes that are used to easily distinguish voltage ranges (e.g. red for 380V-480V, black for 500V-1000V etc.).

The specifications for four-pole plug assemblies (three phase conductors "p" and one protective conductor) can be found in the bottom ten lines of the table. Two of these are of particular interest for the present example a use in cooling containers and therefore are illustrated graphically next to the table:

Variant "A": Protective conductor at $6^h$: operation at 380-415 Volt, 50 or 60 Hz;

Variant "B": Protective conductor at $3^h$: Operation at 380 V, 50 Hz or 440 Volt, 60 Hz.

Conventional cooling containers have a standardized, 4-pole 32 A-plug connection, which is unchangeably set to $3^h$ (variant "B" in FIG. 1). Sockets from 16 to 32 A are permitted for this clock position and are either connected to 380V at 50 Hz or to 440V at 60 Hz.

Since cooling containers are becoming more widespread worldwide, it oftentimes happens that the end customer has only installed a standard socket 32 A/4-pole/$6^h$ (variant "A" in FIG. 1). This socket is (with the same color code: red) connected to 380-415V. The cooling containers could easily be connected there, when the clock position of the plug would fit. Since cooling containers contain perishable goods, a fast solution is required which in practice often involves to simply cut off the distinctive nose of the plug. This overrides the mechanical clock coding and the plug can be inserted into the existing standard socket. In view of the absent distinctive nose, its operating permit is, however, rescinded, and the container plug must be replaced. Moreover, there is acute risk because the faulty plug can now be inserted in all sockets of suitable size and number of poles, which, for example, have the clock position "$5^h$" voltages of 600 to 690V, for which normally the clearance and creepage distance of a $3^h$ plug are not designed.

A simple solution of the described problem is realized with a plug assembly, in which the position of the protective conductor contact element can be exchanged with that of an outer conductor contact element.

In this context, so-called phase reverser plugs according to DIN EN 60309-2 should be reminded of, which swap the position of two adjacent phase pins by mechanical rotation so as to change the rotation direction of the rotating field. Since the rotor or the turning device, which implements the pin swap, can be actuated from outside, no rewiring of the plug is necessary. The turning device also has mechanical end positions; but even without these a plug could not be inserted into a socket, when the pins are not appropriately positioned to the contact sleeves.

An plug according to the invention for solving the afore-described cooling container problem is now being built such that a "clock change"—i.e. the change in position of the protective conductor contact pin ("PE pin") with an outer conductor contact pin ("PH pin")—establishes a modified plug having a mating face which can only be inserted into a socket that has a voltage and frequency which does not significantly differ from the socket with the original clock position. Such an "electric resemblance" is encountered between the $3^h$ and $6^h$ clock position of the variants "A" and "B" of FIG. 1, which in addition have the same color code.

FIG. 2 shows by way of a perspective view a plug 100 according to the afore-explained concept. The plug 100 includes a casing 101 with a collar 102 in surrounding relation to four contact pins K1, K2, K3 and PE. A first of these contact pins, K1, is arranged together with a second contact pin, PE, on a turning device 110 ("rotor"). The first contact pin K1 and the pins K2, K3 are each internally connected to an outer conductor (not shown), the contact pin PE of slightly thicker diameter to a protective conductor (not shown).

Figure 3:
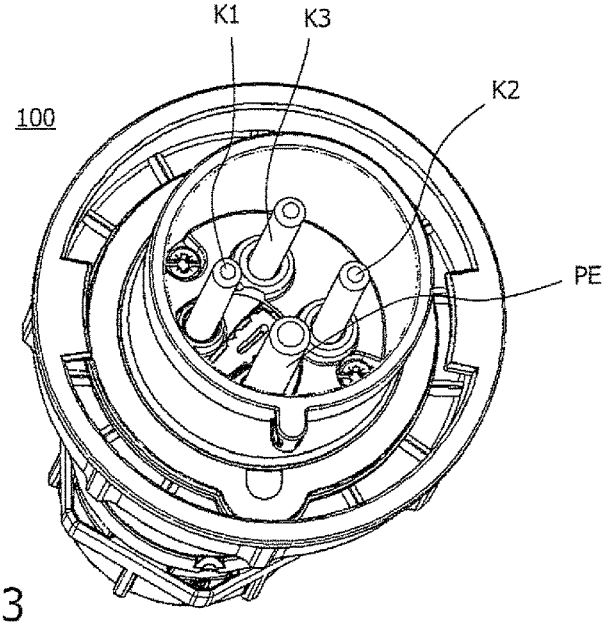
FIG. 3 the plug with the protective conductor contact element in the $6^h$ position.

In FIG. 2, the protective conductor contact pin PE assumes the $3^h$ position. In contrast thereto, FIG. 3 shows the plug 100 after a rotation of the turning device 110, so that the protective conductor contact pin PE has swapped its position with the first contact pin K1 and is now in the $6^h$ position. It should be noted in this context that the clock positions are defined "correct in clock time" for the plug openings of the sockets; when looking at the pins of a plug, the clock positions are therefore reversed.

Advantageously, the rotation direction of the electric field does not change as a result of the position change of the contact pins K1 and PE, so that the running direction of connected motors is maintained.

To carry current and voltage, a plug must be plugged into a socket. On the other hand, a contact pin exchange in the plug may only be made in a de-energized state. Such an exchange is therefore possible by design only in the non-plugged state, because of the need to actuate the "internal" rotor 110 (rotated by 180°) with the help of a screwdriver. For this purpose, the screwdriver blade is placed in the slot 111 of the movable nose of the rotor 110. By putting pressure on the nose, it bends elastically inwards, thereby mechanically unlocking the rotor, which can then be rotated by 180° in the specified direction. As the screwdriver pressure is removed, the nose springs back and locks the position of the rotor again mechanically in the other end position. There is no need to seek for the correct position of the rotor, but is established automatically and intuitively by mechanical end stops. Details of the described mechanism of actuation by a rotatable and lockable rotor can be found, for example, in EP 841 726 A2.

The described configuration of the plug 100 allows a technical layman the secure connection of a typical container plug (with the "special" $3^h$ clock position) to a widespread standard socket (in $6^h$ clock position), without implementing any plug combination—dangerous for life and limb—as a result of an irreversible damage to the plug.

Regardless of the example shown in greater detail above, the exchange of different contact elements can also be used in other applications. In general, the invention relates to a multi-pole plug assembly, in which a turning device, enables an exchange of the positions of a first contact element and a second contact element. The first and the second contact elements may be different in terms of their plug compatibility, for example, by being realized as contact pins of different diameters. In addition or as an alternative, the first contact element can be connected to an outer conductor and the second contact element to a protective conductor.

What is claimed is:

1. A multi-pole plug assembly, comprising:

at least three contact elements, each contact element constructed as a contact pin;

a turning device, on which a first one of the contact elements and a second one of the contact elements are arranged such that positions of the first and second contact elements are exchangeable in relation to a third one of the contact elements and the first contact element is connected to an outer conductor and the second contact element is connected to a protective conductor or a neutral conductor, said first and second contact elements having different diameters and being configured differently in terms of their plug compatibility; and a distinctive structure disposed on the plug assembly and configured to engage with a uniqueness groove of a complementary plug assembly only in a predefined relative rotational position, when the first contact element is positioned at a 3 o'clock position and the second contact element is positioned at a 6 o'clock position, or vice versa, when viewed in the direction of the complementary plug assembly, wherein configurations resulting through exchange of the first contact element and the second contact element (PE) enable a safe operation of the plug assembly in connection with a plug assembly according to the standard DIN EN 60309-2.

2. The multi-pole plug assembly of claim 1, configured with respect to the positions and/or shapes of the contact elements according to standard DIN EN 60309-2.

3. The multi-pole plug assembly of claim 1, configured for fixed connection to a device, in particular to a cooling unit.

4. A cooling unit, in particular in combination with a mobile refrigerated container, said cooling comprising a plug assembly comprising at least three contact elements, each contact element constructed as a contact pin, and a turning device, on which a first one of the contact elements and a second one of the contact elements are arranged such that positions of the first and second contact elements are exchangeable in relation to a third one of the contact elements and the first contact element is connected to an outer conductor and the second contact element is connected to a protective conductor or a neutral conductor, said first and second contact elements being configured differently in terms of their plug compatibility; and a distinctive structure disposed on the plug assembly and configured to engage with a uniqueness groove of a complementary plug assembly only in a predefined relative rotational position, when the first contact element is positioned at a 3 o'clock position and the second contact element is positioned at a 6 o'clock position, or vice versa, when viewed in the direction of the complementary plug assembly, wherein configurations resulting through exchange of the first contact element and the second contact element PE) enable a safe operation of the plug assembly in connection with a plug assembly according to the standard DIN EN 60309-2.

* * * * *